US007487580B1

(12) United States Patent
Schele et al.

(10) Patent No.: US 7,487,580 B1
(45) Date of Patent: Feb. 10, 2009

(54) METHOD OF FORMING A SELF DISSIPATING SNOW ABATEMENT SYSTEM

(76) Inventors: Donald W. Schele, HC 35 Box 204, Wasilla, AK (US) 99654; Marvin D. Smith, HC Box 204, Wasilla, AK (US) 99654

( * ) Notice: Subject to any disclaimer, the term of this patent is extended or adjusted under 35 U.S.C. 154(b) by 0 days.

(21) Appl. No.: 11/983,539

(22) Filed: Nov. 9, 2007

Related U.S. Application Data

(62) Division of application No. 11/179,389, filed on Jul. 11, 2005.

(51) Int. Cl.
*B23P 13/04* (2006.01)
*C09K 17/00* (2006.01)
*E01F 7/02* (2006.01)

(52) U.S. Cl. ..... 29/557; 405/302.4; 405/302.6; 405/258.1; 256/12.5

(58) Field of Classification Search ..... 256/1, 256/12.5; 405/302.4, 302.6, 258.1; 29/557; 37/197, 219; 52/741.13, 749.09
See application file for complete search history.

(56) References Cited

U.S. PATENT DOCUMENTS 3,473,786 A * 10/1969 Luebke ..... 256/12.5
3,539,014 A * 11/1970 Jonsson ..... 37/219
3,792,539 A * 2/1974 Clark ..... 37/448
4,774,777 A * 10/1988 Brochu et al. ..... 37/197
4,798,498 A * 1/1989 Hallberg ..... 405/302.6
2006/0059727 A1* 3/2006 Yoder ..... 37/266

OTHER PUBLICATIONS

Team Snowtastic [online], Dec. 12, 2007 [retrieved on Aug. 8, 2007]. Retrieved from the Internet:<URL: http://web.archive.org/web/20021207060653/http://www.teamsandtastic.com/monster/>. Published date of Dec. 7, 2002 verified by <URL:http://web.archive.org>.*

* cited by examiner

*Primary Examiner*—Victor MacArthur
(74) *Attorney, Agent, or Firm*—Michael J. Tavella

(57) ABSTRACT

A snow fence system made of snow itself, intended for use around construction sites, like raised pads, commonly used in oil, mining and construction. The snow fence is built in stages. After the first significant snowfall, the pad is cleared by pushing the snow to the windward side of the pad. The pile is then shaped to make a steep flat wall surface. As snow accumulates behind the fence, it is cleared by building a higher wall in front of the first wall. The new wall is higher than the first wall and it too is given a steep vertical face. As additional snow accumulates, the fence is built out further from the pad, using the material from the excavated trenches to build additional walls. Once the fence is in place, the pad remains virtually snow free from drifting. At the end of the season, the fence simply melts away.

5 Claims, 8 Drawing Sheets

METHOD OF FORMING A SELF DISSIPATING SNOW ABATEMENT SYSTEM

CROSS REFERENCE TO RELATED APPLICATIONS

This application is a division of application Ser. No. 11/179,389 filed on Jul. 11, 2005 now copending.

STATEMENT REGARDING FEDERALLY SPONSORED RESEARCH AND DEVELOPMENT

Not Applicable

BACKGROUND OF THE INVENTION

1. Field of the Invention

This invention relates to snow abatement systems and particularly to self-dissipating snow abatement systems.

2. Description of the Prior Art

In northern latitudes, snow is often a problem. Not only does snow accumulate, requiring a large expense for removal, it also causes drifts in windy locations. These drifts can create huge snow piles even in areas that do not receive large quantities of snow. Typically, snowdrifts accumulate around natural windbreaks. Unfortunately, most man-made structures also act as windbreaks. Thus, buildings, construction sites, roads and other structures are all subject to drifting problems. There are well known techniques for limiting the impact of snowdrifts. For example, building placement allows the snow to drift around the less important parts of a building. Moreover, proper road placement can easily prevent drifting on the roads. However, these techniques merely redirect the flow of the snow-they do not prevent the drifts; rather, they minimize the impacts of the drifts.

Snow fences are often used to prevent drifting around sites. These fences become the "natural" windbreak and accumulate the drifts before the snow reaches the site to be protected. Although useful, these snow fences do not eliminate the drifting problem; they postpone it until the fence is buried. Once buried by drifts, the snow fence no longer provides any protection. Snow fences create another problem in the warmer periods-they are unsightly, need maintenance and sometimes act as impediments to travel when snow is not a problem.

BRIEF DESCRIPTION OF THE INVENTION

The instant invention overcomes all of these problems. The invention is a snow fence system made of snow itself. The advantages of using snow are several. First, it is a natural substance that is self-removing. As the weather warms, the snow fence eventually disappears. Second, it requires less equipment and manpower for snow removal and cleanup around sites. Third, it makes the sites much safer as there is less snow buildup on the work site. Finally, by restricting the amount of snow on the site, there is less water buildup from the eventual snowmelt. This reduces subsidence of construction pads from water saturation.

The invention is intended for use around construction sites, and specifically around raised pads, commonly used in oil, mining and construction. Once a pad is built, the pad acts as a barrier, which causes snow to drift and accumulate on the pad. The snow fence is built in stages. After the first significant snowfall, the pad is cleared by pushing the snow to the windward side of the pad. The pile is then shaped to make a steep flat wall surface. As snow accumulates behind the fence, it is cleared by building a higher wall in front of the first wall. This is done by excavating snow from in front of the wall, forming a trench and moving it forward. The new wall is higher than the first wall and it too is given a steep vertical face. As snow continues to drift, it accumulates in front of the wall and blows over the wall, where it accumulates in the trench. As additional snow accumulates, the fence is built out further from the pad, using the material from the excavated trenches to build the wall higher. Once the fence is in place, the pad remains virtually snow free from drifting.

Finally, at the end of the season, a bulldozer or excavator is used to push pathways perpendicular to the run of the fence at different locations to circulate air for accelerated melting of the snow. After a short period, the accumulated snow melts, leaving a pristine work area and no impediments of any kind during the warmer months.

DETAILED DESCRIPTION OF THE INVENTION

Figure 1:
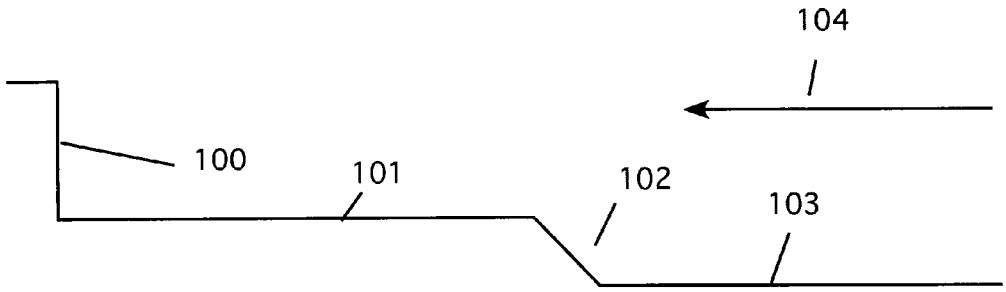
Figure 1 Prior Art
FIG. 1 is a cross-sectional view of a typical well house and pad on a ground surface as prior art.

Referring now to FIG. 1, a typical well site, as prior art, is shown. Here, the well house 10*o* is placed on a gravel pad 101 that has sloped sides 102. The gravel pad is typically built over a ground surface 103, such as arctic tundra or other similar surfaces. The arrow 104 shows the prevailing wind direction.

Figure 1A:
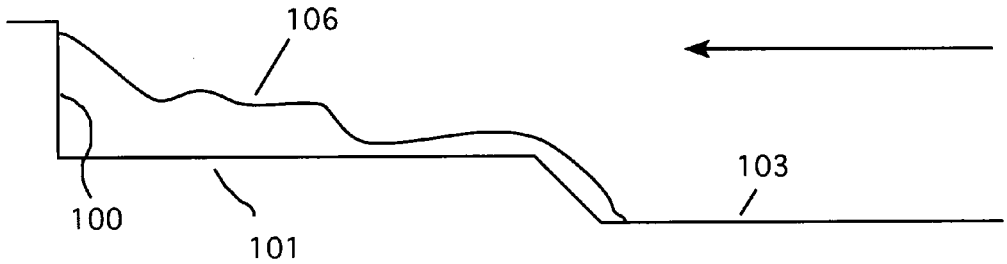
Figure 1a Prior Art
FIG. 1*a* is a cross-sectional view of a typical well house and pad on a ground surface showing the affect of snowdrift accumulations on the well pad as prior art.

FIG. 1*a* shows the site with an accumulation of drifted snow 106. Snow accumulates in front of the pad when the wind then propels it over the sloped sides. It then travels horizontally until it reaches the well house 100 or other structures on the pad. It then builds a berm adjacent to the structure. When this happens, the site is often obscured by the snow. Moreover, building access may be impeded by the size of the drifts.

Figure 2:
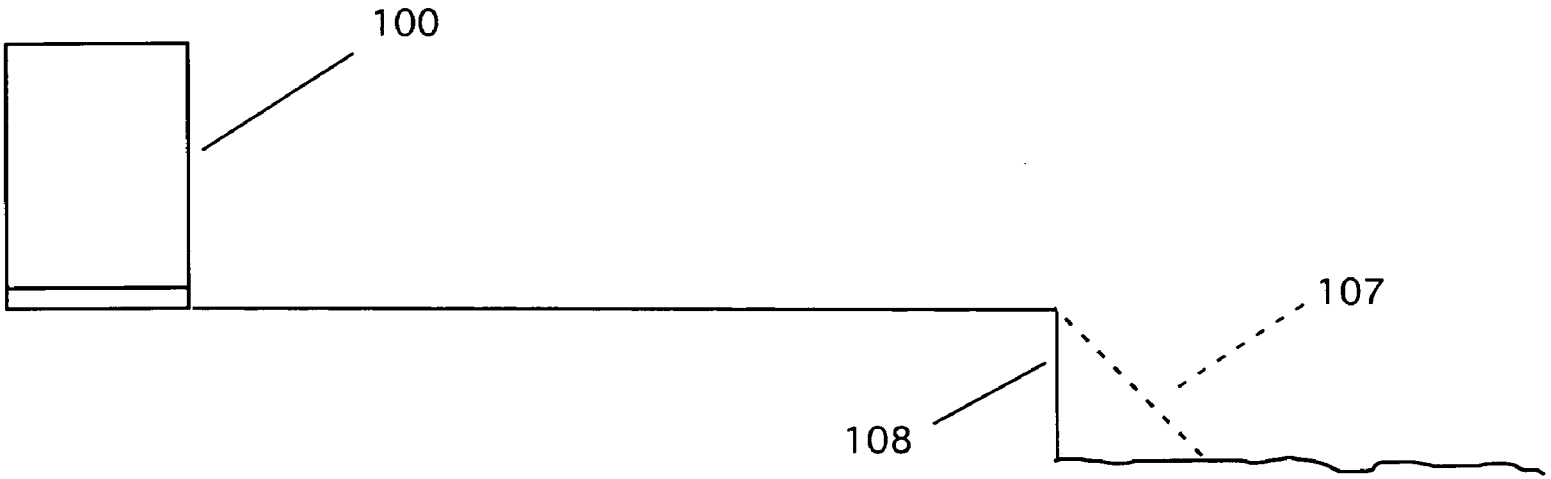
FIG. 2 is a cross-sectional view of a typical well house and pad on a ground surface shown prior to the first snowfall accumulations, where gravel is removed to form a first wall to catch initial snowfall.

FIG. 2 shows a site before the first snowfall has accumulated. The pad has a quantity of gravel 107 that typically soughs off the pad, forming a slope as shown. The first step in the process is to remove the sloughed gravel from the windward side of the raised pad, which forms a vertical gravel wall 108 on the windward side of said raised pad.

Figure 3:
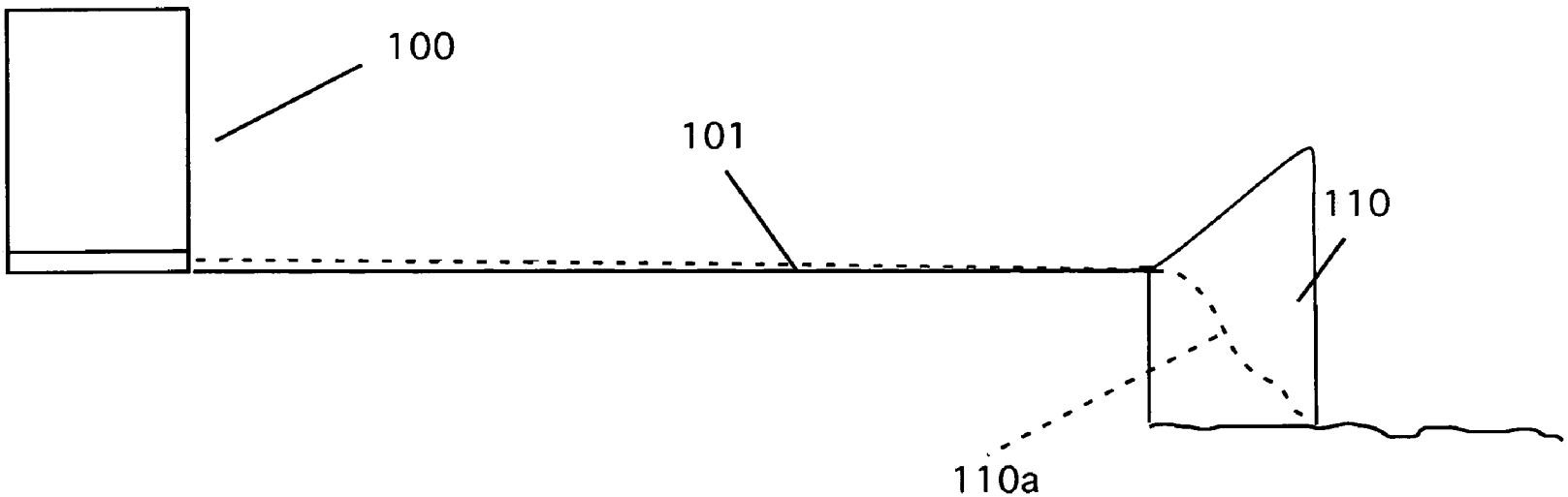
FIG. 3 is a cross-sectional view of the site showing the formed snow wall at the end of the pad.

FIG. 3 is a view of the pad with the first snow wall 110 in place. The snow wall 110 is made of compacted snow that has a formed square front edge. The snow wall is built up from the snow 110*a* that has accumulated on the pad and on the windward face. In the preferred embodiment, the first wall is built with a 4 to 1 slope to gain height. Note that the front face is vertical (see also FIG. 6).

Figure 4:
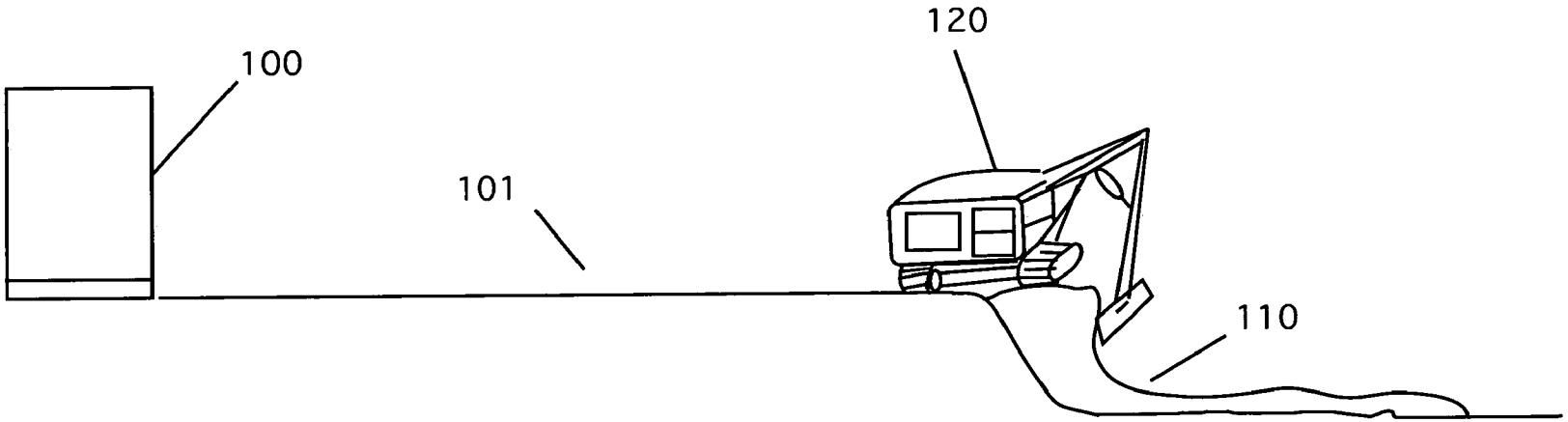
FIG. 4 is a cross-sectional view of the site showing an excavator pulling show from the ground in front of the pad to build up the snow wall.

FIG. 4 shows the snow wall 110 being formed. Snow is removed from the pad 101 by moving it to the edge of the pad nearest the prevailing wind using a height adjustable plow 120. Note that the blades should be adjusted to remove the snow but not the gravel. Adjustable wheels (not shown), for example, set at one inch above the ground surface, ensure that the gravel is not disturbed. Once the snow is accumulated along the length of the pad, additional snow is pulled from in front of the pad to form the first wall. This operation is shown in FIG. 4. This wall need not be much higher than the pad itself, as shown in FIG. 3. Note the dashed line 107 in FIG. 3 shows the original snow accumulation in front of the pad.

Figure 5:
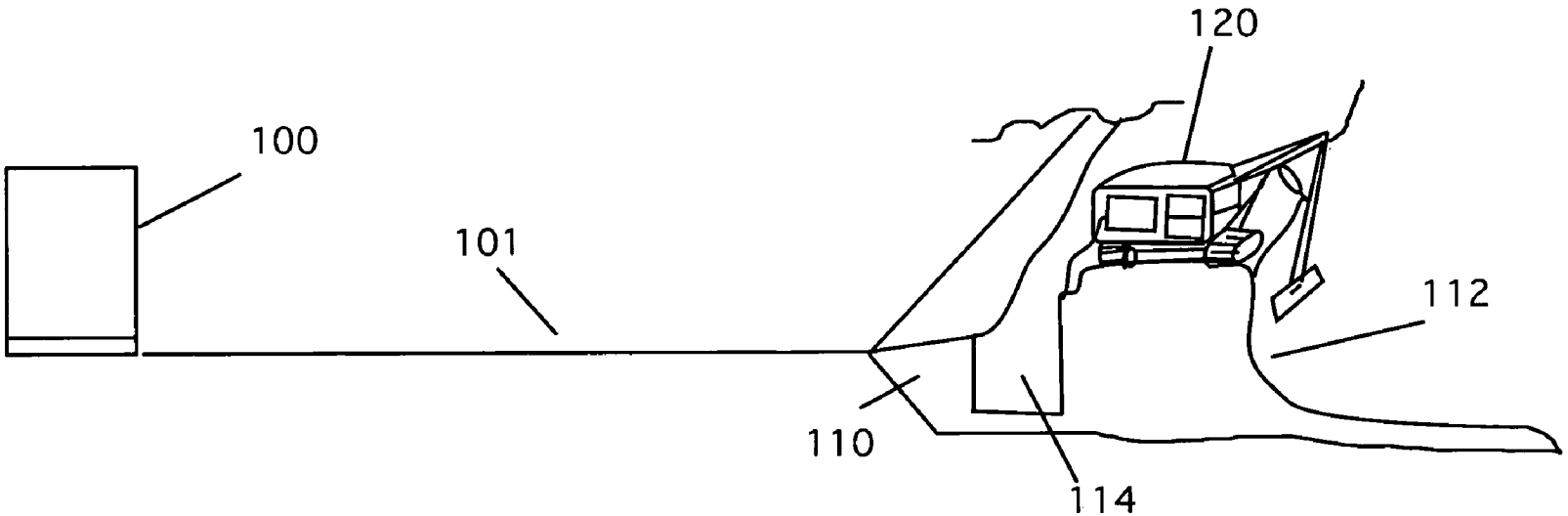
FIG. 5 is a cross-sectional view of the site showing a second stage wall being formed.
Figure 6:
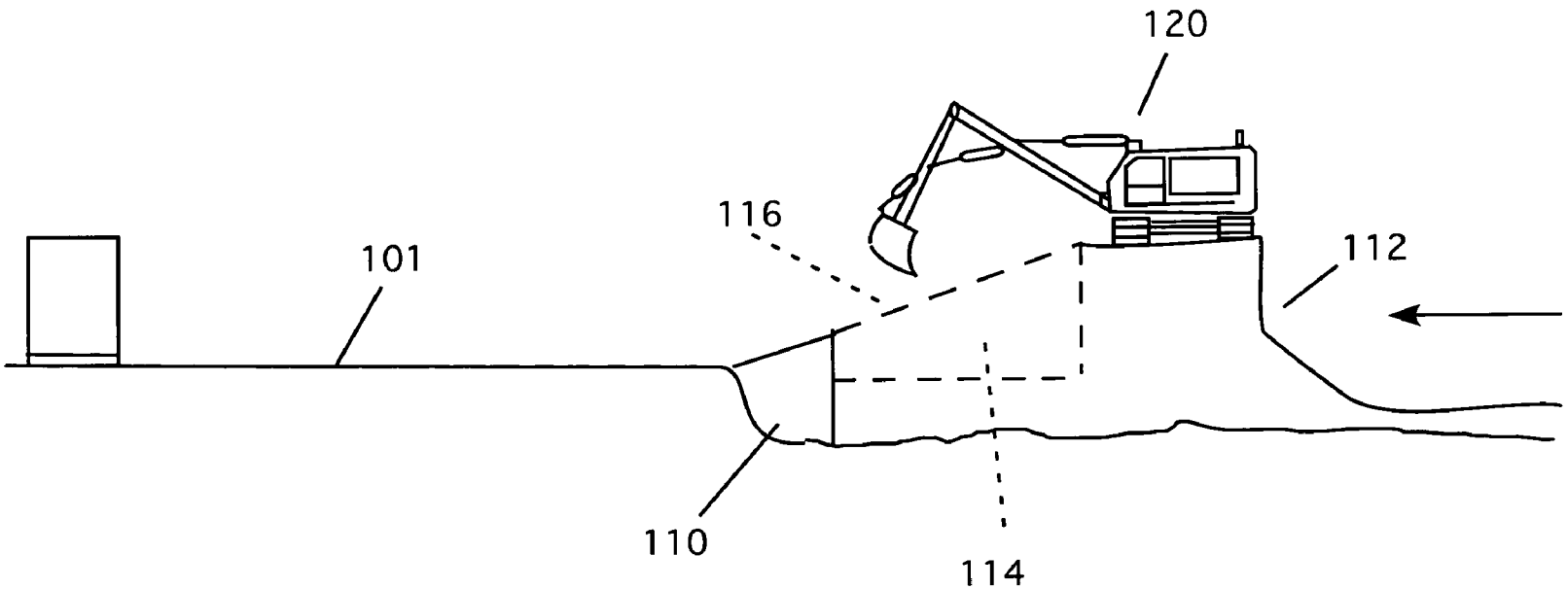
FIG. 6 is another cross-sectional view of the site showing a second stage wall being formed.

FIG. 5 shows the formation of the second wall 112. As additional snow falls, very little wind driven snow accumulates on the pad-because of the first wall. Rather, it accumulates in front of the wall. This snow is then dug out and pushed into a second wall, spaced apart from the first wall. FIG. 6 shows the excavator 120 excavating the trench 114 (the dashed lines represent the snow level prior to excavating and the height of the second wall 115, based on the slope of line 116. Once the excavator 120 has dug the trench 114 and formed the wall, additional snow is pulled from in front of the second wall to further build it up. Note that the wall is built up and is spaced apart from the first wall.

Figure 7:
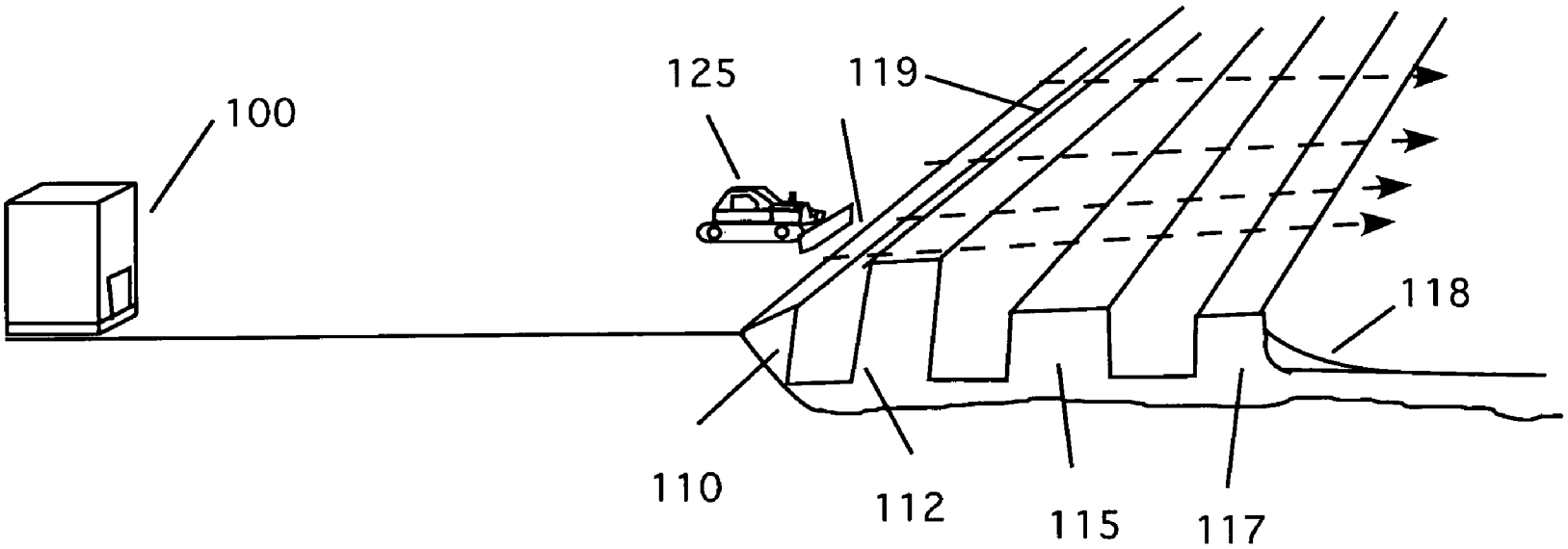
FIG. 7 is a partial perspective view of a site at the end of the season, showing a fully developed snow wall system ready to be partially cleared.

As the season progresses, blown snow accumulates in front of the second wall, with very little accumulating in the trench between the walls and almost none on the pad. When the drifted snow reaches a sufficient level, the snow is excavated as before and a third wall 115 is formed. See e.g., FIG. 7. In this figure, four snow walls have been formed, each further from the pad. Note that the height of these later walls does not have to be as high as the second wall. Moreover, depending on snow conditions the additional wall may not be needed. FIG. 7 shows the walls and accumulated snow 118 at the front of the last wall.

FIG. 7 also shows the snow system at the end of a typical season (of course, the actual number of walls depends on the total snowfall in any given season and may be more or less than those shown in FIG. 7). One of the main advantages of the snow wall system is that, at the end of the winter season, it is completely removed automatically. This reduces any impact on a fragile ground surface, as heavy equipment is not needed to move it. However, it is preferred to cut sections 119, preferably about 15 feet wide, at spaced intervals in the walls to open pathways for air circulation to hasten the melting of the snow wall system. FIG. 7 shows a bulldozer 125 in position to push the pathways.

Figure 8:
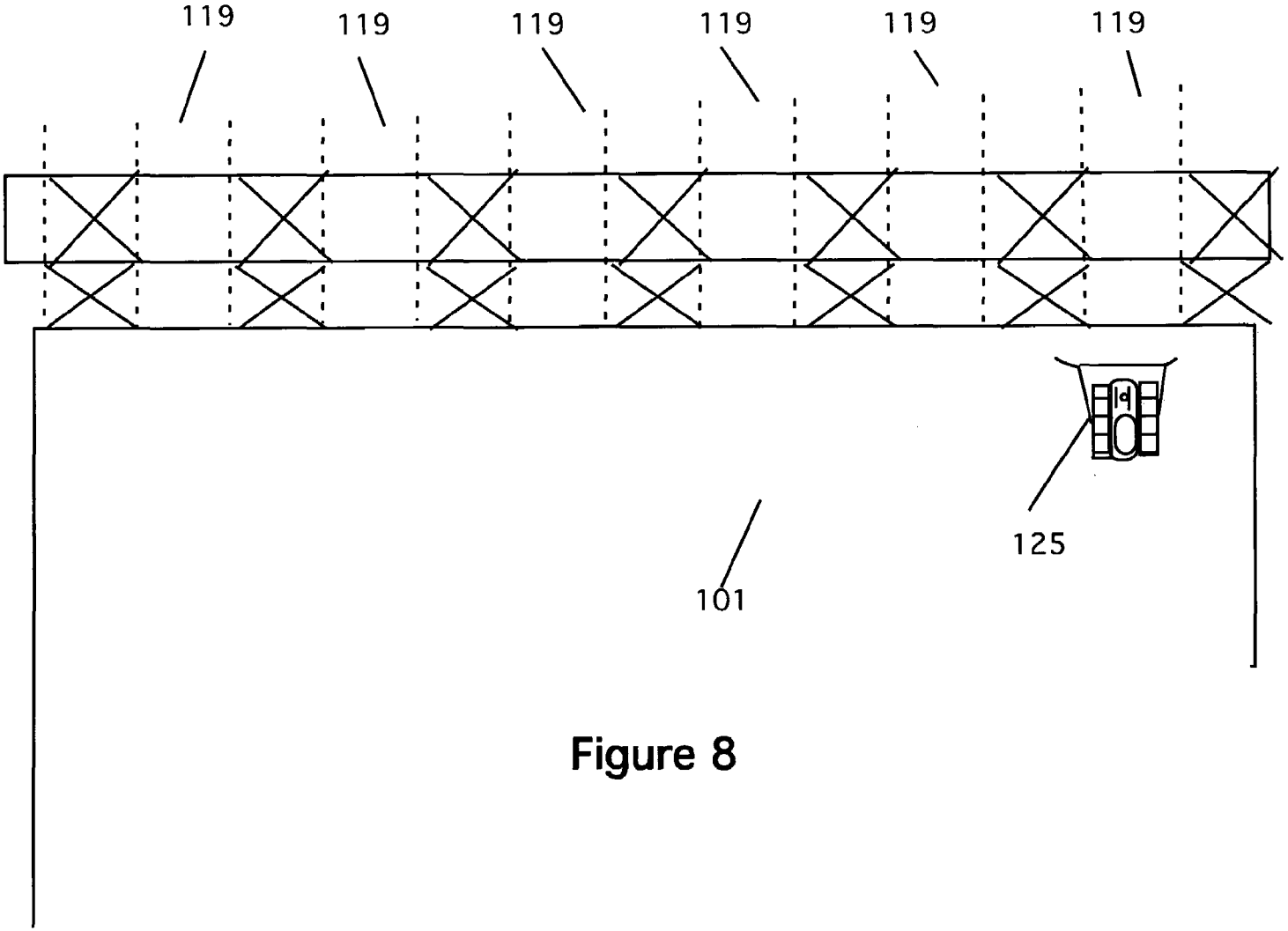
FIG. 8 is a top plan view of a site showing the removal plan for clearing the snow wall.

FIG. 8 is a plan view of a pad showing the well houses and the snow wall system. It also shows the pathways 119 to be cut through the walls and drifted snow.

As mentioned above, this should be done from the pad out to the ground surface to minimize impacts on the unprotected ground surface.

In this way, a simple, effective and environmentally friendly method of preventing snow accumulation is developed. After the spring, when the snow has melted, there is no residual sign of the snow fences, unlike the wooden or metal fences currently used. When the winter season returns, the wall system can be easily built as before for less cost then that of constantly moving snow from the pads as the drifts accumulate. Finally, because the material for the fence is the snow itself, there is no cost to ship anything for use as the fence.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

We claim:

1. A method of forming a snow fence on a windward side of a raised gravel pad comprising the steps of:

a) excavating a quantity of sloughed gravel from the windward side of said raised gravel pad, thereby forming a vertical gravel wall on the windward side of said raised pad;

b) forming a first snow wall adjacent to said windward side of said raised gravel pad, said first snow wall having a vertical outer face;

c) allowing a period of time for additional snow to accumulate;

d) forming a second snow wall parallel to said first snow wall by excavating a quantity of additional snow from an area in front of said first snow wall and applying it to said second snow wall, thereby forming a trench between said first and second snow walls, said second snow wall also having a vertical outer face.

2. The method of claim 1 wherein the first snow wall has a height and the second snow wall has a height greater than the height of the first snow wall.

3. The method of claim 1 wherein said snow wall is removed by allowing the snow walls to melt.

4. The method of claim 3 further comprising the step of forming a plurality of channels in said snow walls to promote faster melting.

5. The method of claim 1 further comprising the step of:

a) forming a third snow wall parallel to said second snow wall by excavating a quantity of additional snow, after additional quantities of snow accumulate, from an area in front of said second snow wall and applying it to said third snow wall, thereby forming a trench between said second and third snow walls, said third snow wall also having a vertical outer face.

* * * * *